United States Patent [19]

Oakley

[11] Patent Number: 4,931,686

[45] Date of Patent: Jun. 5, 1990

[54] COPPER CORE SIDE ELECTRODE SPARK PLUG SHELL

[75] Inventor: Charles D. Oakley, Lapeer, Mich.

[73] Assignee: General Motors Corporation, Detroit, Mich.

[21] Appl. No.: 240,286

[22] Filed: Sep. 6, 1988

[51] Int. Cl.[5] ..... H01T 13/20; H01T 13/32

[52] U.S. Cl. ..... 313/141; 313/143; 313/144; 445/7

[58] Field of Search ..... 313/122, 125, 141, 143, 313/144; 123/169 EL, 169 CB, 169 EB; 445/7

[56] References Cited

U.S. PATENT DOCUMENTS

| | | | |
|---|---|---|---|
| 1,762,989 | 6/1930 | Hurley | 313/141 |
| 1,941,279 | 12/1933 | Sharpnack | 123/169 |
| 2,597,718 | 5/1952 | Field | 123/169 |
| 3,017,532 | 1/1962 | Talmey | 313/141 |
| 4,826,462 | 5/1989 | Lenk | 427/34 |

*Primary Examiner*—Palmer C. DeMeo
*Assistant Examiner*—Michael Horabik
*Attorney, Agent, or Firm*—Douglas D. Fekete

[57] ABSTRACT

A metal spark plug shell includes an L-shaped copper core side electrode secured in an axially extending slot on the metal shell. The side electrode includes an attachment end having a portion with an outer side that is threaded contiguous with the metal shell and another portion adjacent the end of the metal shell with a recessed outer side that is unthreaded so as to permit spark plug gapping without breakage of the side electrode. The heat-resistant sheath around the copper core on the inner side of the attachment end may be spot welded to the metal shell.

10 Claims, 1 Drawing Sheet

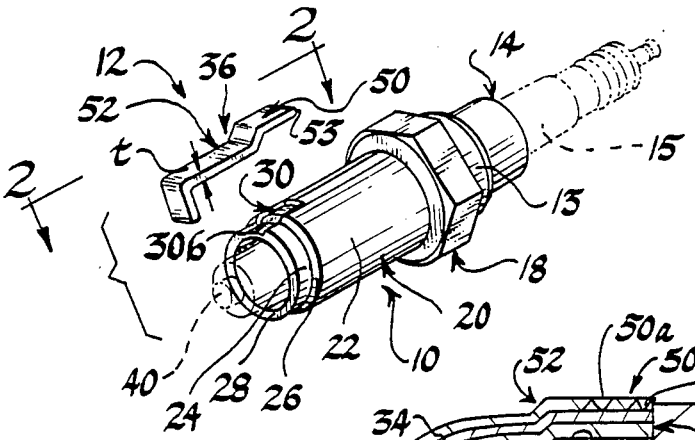
Fig. 1
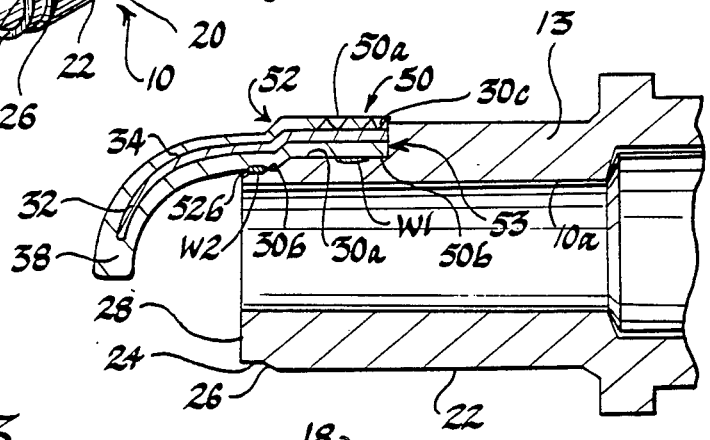
Fig. 2
Fig. 3
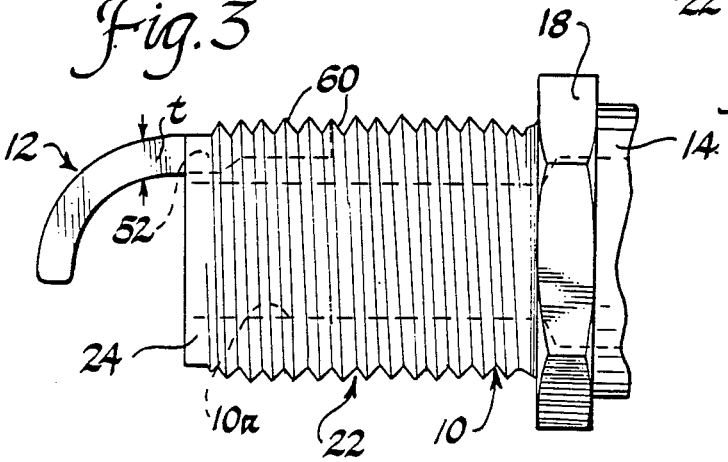
Fig. 4
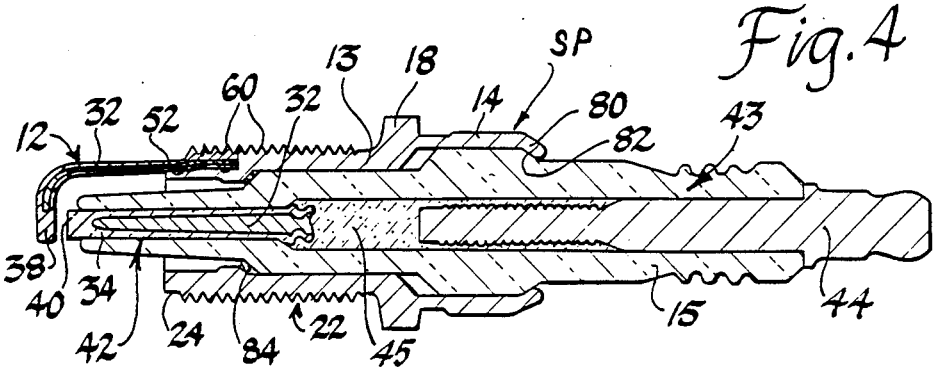

COPPER CORE SIDE ELECTRODE SPARK PLUG SHELL

FIELD OF THE INVENTION

The present invention relates to spark plugs and, more particularly, to a metal spark plug shell having a composite (copper core) side electrode secured thereon and to a method of making such a metal spark plug shell.

BACKGROUND OF THE INVENTION

A conventional spark plug typically includes a ceramic insulator body having a center electrode and an outer metal shell assembled around the insulator body and having a side electrode that is bent in an L-shape to cooperate with the center electrode to generate a spark therebetween when an electrical voltage is applied between the electrodes.

It is known to make the center electrode as a composite electrode having a copper (or copper alloy) core in an outer, oxidation-resistant nickel (or nickel alloy) sheath to improve the service life and performance of the spark plug.

In the past, the L-shaped side electrode has most often been made of nickel-base alloys and has included one end resistance butt welded to an end lip of the metal spark plug shell.

It has been proposed to make the L-shaped side electrode of the same composite material (copper core in a nickel sheath) as the center electrode to further improve the service life and performance of the spark plug. However, current production technology of copper core electrodes is limited to producing one end where the copper core is sealed in the outer sheath and an opposite end where the copper core is exposed. Since the sealed end must be positioned adjacent the center electrode, the exposed core end is all that is available for attachment to the metal spark plug shell.

Attempts to butt weld the exposed core end of the copper core side electrode to the end lip of the metal spark plug shell have been unsuccessful as a result of the presence of the exposed copper core at the butt weld joint. In particular, the exposed copper core at the weld joint provides a low resistance path for the welding current and results in a weld joint of unsatisfactory strength.

In order to butt weld the end of the copper core side electrode to the end lip of the metal shell, a substantial amount of weldable material must be provided on the end of the copper core side electrode to be welded. However, as mentioned hereinabove, current production technology of copper core electrodes is limited to producing one end where the copper core is sealed in the outer sheath and an opposite end where the copper core is exposed.

It is an object of the invention to provide a metal spark plug shell having a copper core side electrode secured in an axially extending slot in the shell in such a manner as to enable subsequent gapping of the side electrode without breakage thereof and to a method for making such a metal spark plug shell.

SUMMARY OF THE INVENTION

The invention contemplates a method of making a metal spark plug shell having a composite (copper core) side electrode attached thereon including the steps of (a) forming a hollow metal shell body with an end having a cylindrical first outer surface and an adjacent second outer surface recessed radially inwardly of the first outer surface and disposed axially outboard of the first outer surface so as to terminate in an annular end lip, (b) forming a slot in the end extending axially from the first outer surface along the second outer surface toward the end lip whereby said slot includes a first slot portion in the first outer surface and a second slot portion in the second outer surface, (c) securing an axially extending attachment end of the side electrode in the slot with a first attachment portion of the attachment end disposed in the first slot portion and having an outer side at least substantially radially coextensive with the first outer surface and with a second attachment portion of the attachment end disposed in the second slot portion and having an outer side recessed radially inwardly of the first outer surface, and (d) forming substantially contiguous threads on the first outer surface and the outer side of the first attachment portion, leaving the recessed second outer surface and outer side of the second attachment portion unthreaded to permit gapping of the side electrode without breakage thereof.

In a preferred embodiment of the method of the invention, the copper core is exposed on an innermost axial end of the attachment end and the exposed core is abutted against a blind end of the slot formed in the metal body to enhance heat removal from the side electrode during use. In another preferred embodiment of the method of the invention, the threads may be formed so as to remove sheath metal from the outer side of the first attachment portion of the side electrode and expose the copper core for intimate contact with a cylinder head when the spark plug is installed therein to further enhance heat removal during use.

In still another preferred embodiment of the method of the invention, the attachment end of the side electrode is secured in the slot by welding the outer, oxidation-resistant sheath on the inner side of the attachment end to the metal body, preferably at a weld location on the inner side of the first attachment portion and at another weld location on the inner side of the second attachment portion. The welds on the inner side of the first and second attachment portions provide a welded lap joint capable of withstanding stresses imposed on the joint by subsequent spark plug gapping procedures.

BRIEF DESCRIPTION OF THE DRAWINGS

FIG. 1 is an exploded perspective view of a metal spark plug shell and a copper core side electrode with the insulator body shown in phantom.

FIG. 2 is a partial longitudinal cross-sectional view taken along lines 2—2 of FIG. 1 with the side electrode attached to the spark plug shell in accordance with the invention.

FIG. 3 is a partial side elevation of the side electrode attached to the threaded spark plug shell in accordance with the invention.

FIG. 4 is a longitudinal cross-sectional view of a spark plug including the metal shell of FIG. 3.

DETAILED DESCRIPTION OF THE INVENTION

Referring to FIG. 1, a hollow metal spark plug shell 10 and an L-shaped composite side electrode 12 are shown prior to assembly. The metal spark plug shell 10 includes a hollow metal body 13 having a first end 14 that is deformable (crimpable) onto a ceramic insulator body 15 (shown in phantom) and a second cylindrical end 20 on which the side electrode 12 will be attached as explained hereinbelow. An enlarged shoulder 18 is positioned between the first end 14 and the second end 20 for engagement with a wrench (not shown) for installation of the spark plug SP (FIG. 4) in a cylinder head (not shown).

The second, cylindrical end 20 includes a cylindrical first outer surface 22 and an adjacent cylindrical second outer surface 24 disposed axially outboard of the first outer surface on the end 20 so as to terminate in an annular end lip 28. An intermediate tapered, conical outer surface 26 connects the adjacent outer surfaces 22, 24. The second outer surface 24 is formed with an outer diameter less than that of the first outer surface 22 as can be seen. In this way, the second outer surface 24 is relieved or recessed radially inwardly of the first outer surface 22 for purposes to be explained hereinbelow. The second outer surface 24 may also be formed as a converging conical or other shape surface to provide such radial relief relative to the first outer surface.

In accordance with the invention, a narrow slot 30 is formed in the second cylindrical end 20 and extends axially from the first outer surface 22 along the second outer surface 24 toward the end lip 28 where the slot 30 opens.

The L-shaped side electrode 12 is a composite electrode of generally oval cross-section and includes a copper core 32 in an oxidation-resistant, weldable sheath 34 (e.g., nickel or nickel alloy sheath). The side electrode 12 includes an axially extending attachment end 36 and an outermost sealed end 38 (core 32 sealed in sheath 34) that will be positioned in cooperative relation to the tip 40 of a center electrode 42 in the insulator body 15 of the spark plug SP, FIG. 4.

The attachment end 36 is bent to form a first attachment portion 50 and a second attachment portion 52. The first attachment portion 50 is received in the slot portion **30*a* formed in the first outer surface 22 and the second attachment portion 52 is received in the slot portion 30*b* in the reduced diameter, second outer surface 24, FIG. 2. The circumferential width of the slot portions 30*a*, 30*b* is selected to receive the attachment portions 50, 52 in close tolerance fit. The radial depth of the slot portion 30*a* is selected relative to the thickness t of the attachment end 36 to position the outer side 50*a* at least substantially coextensive (radially) with the first outer surface 22, preferably slightly radially outboard of the first outer surface 22 as shown in FIG. 2. The radial depth of the slot portion 30*b* is selected relative to the thickness t to position the outer side 52*a* of the second attachment portion 52 substantially coextensive (radially) with the second reduced diameter, outer surface 24; that is, both the second outer surface 24 and the outer side 52*a* are sufficiently radially relieved or recessed relative to the first outer surface 22 and the outer side 50*a* so as not to be threaded therewith in a subsequent threading operation to be described hereinbelow. The full thickness of the second attachment portion 52 is thereby maintained at the second outer surface 24 and the end lip 28** for purposes to be explained hereinbelow.

As shown best in FIG. 2, the slot 30 includes an inner blind end **30*c* formed on the metal body 13 and against which an innermost exposed core end 53 of the attachment end 36 of the side electrode 12 is abutted. In particular, the copper core 32 on the exposed axial core end 53 is abutted against the blind end 30*c* of the slot 30. Contact between the copper core 32 and the blind end 30*c* provides a thermally conductive path to remove heat from the side electrode 12** during use in the cylinder head (not shown).

Once the side electrode 12 is positioned in the slot 30 as shown in FIG. 2, the inner sides **50*b*, 52*b* of the respective first and second attachment portions 50, 52 are resistance spot welded to the portion of the shell blank 10 forming the bottom of the slot 30 at weld locations W1, W2 to form a welded lap joint. In particular, the heat-resistant, weldable nickel sheath 34 is spot welded at the interface with the metal (steel) shell blank 10 at the weld locations W1, W2. Resistance spot welding is effected in conventional manner by placing one welding electrode (not shown) on the inside surface 10*a* of the shell 10 and the other opposing electrode on the outer surface 22 or 24 of the respective attachment portion 50 or 52. Spot welds are thereby produced between the nickel sheath 34 on the inner sides 50*b*, 52*b* and the metal (steel) shell blank 10 at locations W1, W2 as shown best in FIG. 2**.

Following welding of the attachment end 36 of the side electrode 12 in the slot 30, the metal shell blank 10 is subjected to a thread rolling or other forming operation to form threads 60 on the outer surface 22 and the outer side **50*a* of the side electrode 12 contiguous with one another, FIGS. 3 and 4. Contact across the threads between the side electrode 50 and the cylinder head provides a thermally conductive path to remove heat from the side electrode 12** during use.

FIGS. 3 and 4 illustrate that the thread rolling operation does not form threads on the second outer surface 24 or the outer side **52*a* of the attachment portion 52 as a result of the reduced diameter of the second outer surface 24 and the outer side 52*a* relative to the first outer surface 22. This is important as formation of threads, or even partial threads, on the outer side 52*a* would reduce the thickness t of the second attachment portion 52, and thus its strength, and also would create stress concentrators thereon that could result in breakage of the side electrode 12 when it is bent during subsequent gapping procedures. For similar reasons, it is important to form the spot weld at location W2 below (outboard of) the threads 60 since that weld must withstand a majority of the bending force exerted on the side electrode 12** during subsequent spark plug gapping procedures.

After the threads 60 are formed on the outer surface 22 and the outer side **50*a* of the attachment end 36, the threaded metal spark plug shell 10 is assembled with the insulator body 15 by conventional procedures. In particular, an annular lip 80 on the first deformable end 14 of the metal shell 10 is crimped onto the shoulder 82 of the insulator body 15. During the crimping process, the insulator body 15 is axially displaced relative to the threaded metal shell 10 to deformably compress a sealing gasket 84 positioned between the shell 10 and the insulator body 15 to effect an internal seal in known manner. The insulator body 15 surrounds a center electrode 43 having an end portion 42, an outer attachment portion 44, and an intermediate fused glass seal resistor 45. Center electrode end portion 42 comprises a copper core 32 in an outer, oxidation-resistant sheath 34**.

The invention thus provides a metal spark plug shell 10, FIGS. 3 and 4, having a copper core side electrode 12 secured thereon in a manner that permits subsequent spark plug gapping operations in a conventional manner without problems of the side electrode 12 breaking off.

Moreover, attachment of the side electrode 12 in the manner described hereinabove does not require modifications to the subsequent thread forming and assembly (assembly of the shell and the insulator body) operations, which can be practiced in conventional manner.

While in the embodiment described hereinabove the threads 60 were formed in the metal shell 10 by a thread rolling operation, the threads may be suitably formed by other conventional processes, including cutting. Thread cutting may be carried out so as to remove portions of the side electrode in the thread grooves to expose the copper core for contact with the threads of the cylinder head when the spark plug is mounted in the cylinder head for use. Contact across the threads between the cylinder head and the copper core of the side electrode may further enhance heat removal from the side electrode during use.

While the invention has been disclosed in terms of specific embodiments thereof, it is not intended to be limited thereto but rather only to the extent set forth hereafter in the claims which follow.

The embodiments of the invention in which an exclusive property or privilege is claimed are defined as follows:

1. A method of making a hollow metal spark plug shell having a composite side electrode of a copper core in an outer oxidation-resistant sheath attached thereto, comprising:

(a) forming a hollow metal shell body with an end having a cylindrical first outer surface and an adjacent second outer surface recessed radially inwardly of said first outer surface and disposed axially outboard of said first outer surface so as to terminate in an annular end lip, (b) forming a slot in said end extending axially from said first outer surface along said second outer surface toward said end lip whereby said slot includes a first slot portion in the first outer surface and a second slot portion in the second outer surface, (c) securing an axially extending attachment end of the side electrode in said slot with a first attachment portion of said attachment end disposed in said first slot portion and having an outer side at least substantially radially coextensive with said first outer surface and with a second attachment portion of said attachment end disposed in said second slot portion and having an outer side recessed radially inwardly of said first outer surface, and (d) forming substantially contiguous threads on said first outer surface and the outer side of said first attachment portion, leaving the recessed second outer surface and outer side of said second attachment portion unthreaded to permit gapping of the side electrode without breakage thereof.

2. The method of claim 1 wherein, in step (c), the threads are formed on said first attachment portion so as to expose the copper core thereof at the threads to enhance heat removal from the side electrode during use.

3. The method of claim 1 wherein the copper core is exposed at an innermost axial end of the attachment end of said side electrode and is abutted against a blind end of said slot to enhance heat removal from the side electrode during use.

4. The method of claim 1 wherein, in step (b), the attachment end is secured in said slot by welding the outer sheath on the inner side of said attachment end to said metal body.

5. The method of claim 4 wherein the outer sheath is spot welded to said metal body at said first attachment portion and said second attachment portion of said attachment end.

6. A metal spark plug shell for assembly with an insulator body having a center electrode to form a spark plug, comprising:

(a) an elongate hollow metal shell body having an end with a cylindrical threaded outer surface, an adjacent unthreaded outer surface recessed radially inwardly of said threaded outer surface and disposed axially outboard of said threaded outer surface so as to terminate in an annular end lip, and a slot extending axially from the threaded outer surface along the unthreaded outer surface toward said end lip, said slot having a first slot portion in the threaded outer surface and a second slot portion in the unthreaded outer surface, and (b) a composite side electrode having a copper core in an outer oxidation-resistant sheath, said side electrode including an axially extending attachment end secured in said slot, said attachment end including (1) a first attachment portion received in the first slot portion and having an outer side threaded substantially contiguously with said threaded outer surface and (2) a second attachment portion received in the second slot portion and having an unthreaded outer side substantially coextensive with said unthreaded outer surface.

7. The spark plug shell of claim 6 wherein said slot includes a blind end formed in the metal body and the attachment end includes an exposed core end abutted against the blind end of the slot.

8. The spark plug shell of claim 6 wherein said copper core is exposed at the threaded outer side of said first attachment portion.

9. The spark plug shell of claim 6 wherein the first attachment portion is welded on an inner side to said metal body.

10. The spark plug shell of claim 6 wherein the second attachment portion is welded on an inner side to said metal body.

* * * * *